US008016266B2

(12) United States Patent
Bogert

(10) Patent No.: US 8,016,266 B2
(45) Date of Patent: Sep. 13, 2011

(54) PORTABLE APPARATUS AND METHOD FOR LIFTING A VEHICLE THAT COMPENSATES FOR LATERAL MOTION OF THE VEHICLE

(76) Inventor: Richard W. Bogert, Pasco, WA (US)

( * ) Notice: Subject to any disclaimer, the term of this patent is extended or adjusted under 35 U.S.C. 154(b) by 1076 days.

(21) Appl. No.: 11/833,184

(22) Filed: Aug. 2, 2007

(65) Prior Publication Data

US 2008/0128670 A1 Jun. 5, 2008

Related U.S. Application Data

(60) Provisional application No. 60/868,509, filed on Dec. 4, 2006.

(51) Int. Cl.
*B26F 3/00* (2006.01)

(52) U.S. Cl. ..... 254/124; 254/122; 254/134; 254/93 R

(58) Field of Classification Search ..... 254/124, 254/122, 134, 93 R, 89 H
See application file for complete search history.

(56) References Cited

U.S. PATENT DOCUMENTS

| | | | | | |
|---|---|---|---|---|---|
| 1,638,859 | A | * | 8/1927 | Knowles | 254/126 |
| 1,709,746 | A | | 4/1929 | Schwerin | |
| 2,513,246 | A | * | 6/1950 | Moench | 254/122 |
| 2,611,579 | A | | 9/1952 | Guzey, Jr. et al. | |
| 2,906,497 | A | | 9/1959 | Wolf | |
| 3,635,440 | A | * | 1/1972 | Van Gompel | 254/93 R |
| 3,819,153 | A | * | 6/1974 | Hurst et al. | 254/93 R |
| 3,958,793 | A | | 5/1976 | Garate | 254/10 B |
| 4,030,701 | A | * | 6/1977 | Pingon | 254/124 |
| 4,036,474 | A | * | 7/1977 | Owan | 254/124 |
| 4,360,187 | A | * | 11/1982 | Chapman | 254/8 R |
| 4,558,848 | A | | 12/1985 | Rutter | 254/100 |
| 4,583,713 | A | | 4/1986 | Fukura et al. | 254/126 |
| 5,074,622 | A | | 12/1991 | Channell | 298/22 J |
| 5,275,378 | A | | 1/1994 | Alten | 254/126 |
| 5,692,731 | A | * | 12/1997 | Beauchamp | 254/124 |
| 6,070,856 | A | * | 6/2000 | Alten | 254/126 |
| 6,926,254 | B1 | | 8/2005 | Nymann | 254/8 R |
| 7,100,898 | B1 | | 9/2006 | Chang | 254/126 |
| 7,107,812 | B1 | | 9/2006 | Patton et al. | 72/392 |
| 2007/0221895 | A1 | * | 9/2007 | Pieger et al. | 254/124 |

* cited by examiner

*Primary Examiner* — George Nguyen
(74) *Attorney, Agent, or Firm* — Seed IP Law Group PLLC

(57) ABSTRACT

A lift apparatus for lifting a structure includes a base, a bell crank pivotably coupled to the base, a coupling member for engaging a portion of the structure, pivotably coupled to the bell crank device via at least one lift member, and a longeron assembly having a pivoting apex and configured to pivot about the base. The apparatus also includes a biasing device having a first end pivotably coupled to the bell crank device for applying a force thereto, the bell crank device converting the first force to a second force and applying the second force to the coupling member via the lift member for lifting the structure. A movement of the structure is compensated by rotation of portions of the longeron assembly which repositions the apex, the bell crank, and lift arm to maintain the structure in the lifted position.

21 Claims, 8 Drawing Sheets

PORTABLE APPARATUS AND METHOD FOR LIFTING A VEHICLE THAT COMPENSATES FOR LATERAL MOTION OF THE VEHICLE

BACKGROUND

1. Field

The present invention generally relates to lift systems, and more particularly, to an apparatus and method for lifting a portion of heavy vehicles.

2. Description of the Related Art

Portable lifting devices such as car jacks have conventionally included two opposing supports, one for resting on the ground and the other for mating with an adapter on the vehicle, and a leveraging mechanism positioned between the two supports. Typically, the leveraging mechanism operates to increase the distance between the two supports and raise the vehicle or a portion thereof away from the ground.

These devices suffer from stability drawbacks. For example, conventional car jacks are susceptible to being tipped onto one side upon experiencing a side load. Conventional jacks are typically designed to only withstand vertical loads, which makes them less than ideal for lifting a vehicle that is positioned on an incline or a decline, or that can be subject to non-vertical loads. Furthermore, the jack support that rests on the ground is typically configured to rest on a flat firm surface. Accordingly, when lifting on an uneven or soft surface, the jack tends to become unstable, further making conventional jacks susceptible to side loads and other loads.

Lifting devices for larger structure, such as trucks and heavy automobiles, further suffer from portability drawbacks. These devices tend to be bulky and heavy, such that in some cases their transport requires a dedicated vehicle. Most of these larger lifting devices are also prone to tipping on their side when exposed to side loads.

BRIEF SUMMARY

Figure 1:
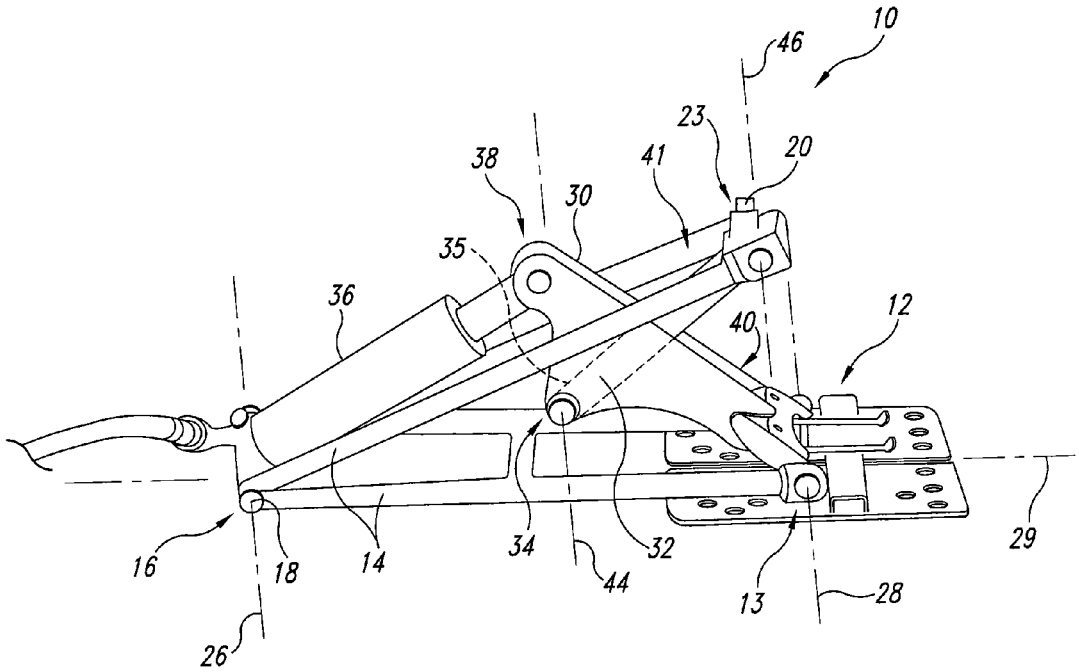
FIG. 1 illustrates an isometric view of a lifting apparatus according to one embodiment.

According to one embodiment, a lifting apparatus for lifting a portion of a vehicle includes a base positioned toward a first end of the lifting apparatus, a bell crank having a first end and a second end, the first end of the bell crank pivotably coupled to the base, and at least a first lift member having a first end and a second end, the first end of the at least first lift member pivotably coupled to a coupling portion of the bell crank positioned between the first and second ends of the bell crank. The lifting apparatus further includes a coupling member pivotably coupled to the second end of the at least first lift member and configured to engage a portion of the vehicle, and a biasing device having a first end and a second end, the first end of the biasing device pivotably coupled to the second end of the bell crank, the biasing device being configured to exert a force on the second end of the bell crank, pivoting the bell crank about the base and shifting the at least first lift member from a first retracted position to a second extended position. The lifting apparatus further includes a longeron assembly having a first end and a second end, the longeron assembly being pivotably coupled to the base toward the first end and rigidly coupled to the coupling member toward the second end, the second end of the longeron assembly pivoting about at least one of a first axis and a second axis, with respect to the base, in response to a movement of the vehicle, the first end shifting with the vehicle and repositioning the biasing device, the bell crank, and the at least first lift member to compensate for the lateral shift of the vehicle, when the coupling member is engaged to the portion of the vehicle and the at least first lift member is in the second extended position.

According to another embodiment, a lift apparatus for lifting a structure includes a base, a bell crank device pivotably coupled to the base and configured to receive a first force having a first direction and convert the first force to a second force having a second direction, a coupling member configured to engage a portion of the structure, the coupling member being pivotably coupled to the bell crank device, and a longeron assembly having a first end, a second end, and an apex positioned therebetween, the longeron assembly being pivotably coupled to the base toward the first end and rigidly attached to the coupling member toward the second end, the second end being configured to pivot with respect to another portion of the longeron assembly about a first axis proximate the apex and with respect to the base about a second axis proximate the base. The lift apparatus further includes a biasing device having a first end and a second end, the first end being pivotably coupled to the bell crank device for applying the first force thereto, the bell crank device converting the first force to the second force and applying the second force to the coupling member for lifting the structure, a lateral shift in a position of the structure being compensated by a rotation in the second end of the longeron assembly repositioning the apex and the bell crank.

According to yet another embodiment, a lifting apparatus for a structure above a surface includes a base configured to rest on the surface to facilitate lifting the structure, a spacing assembly having a first end pivotably coupled to the base and a second end configured to engage a portion of the structure and to move away from the base to cause the lifting apparatus to lift the structure during operation, and an actuating mechanism coupled to the spacing assembly, the actuating mechanism configured to separate the second end of the spacing assembly from the base to lift the structure, wherein a movement of the structure while the structure is being lifted, or when the structure is in a lifted state, is compensated by the spacing assembly pivoting about the base.

DETAILED DESCRIPTION

Figure 2A:
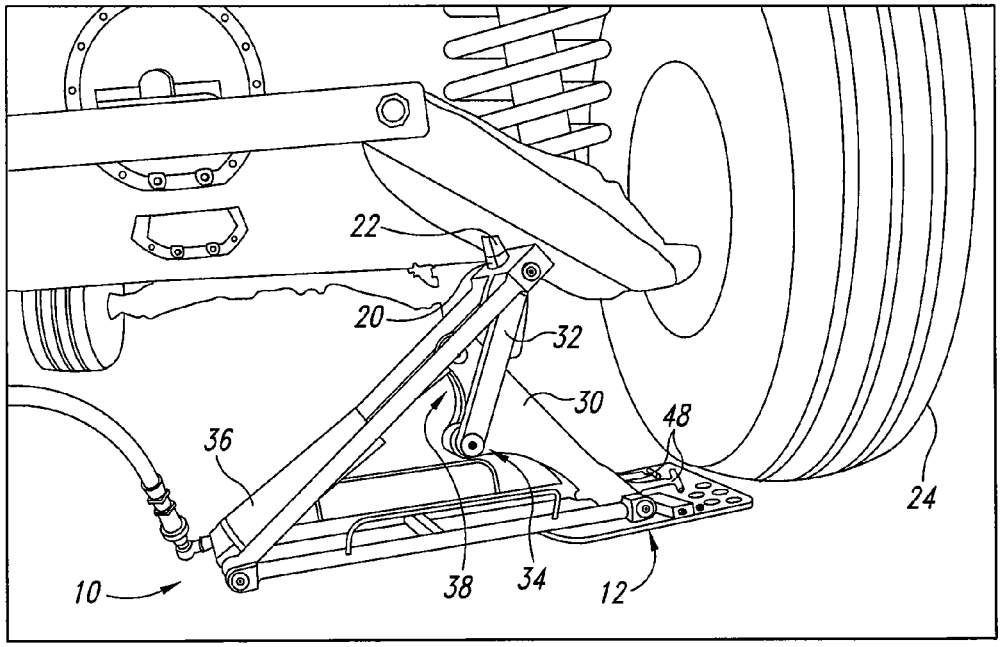
FIG. 2A illustrates an isometric view of the lifting apparatus of FIG. 1 in a first state.

FIG. 1 illustrates a portable lifting apparatus 10 according to one embodiment. The portable lifting apparatus 10 includes a base 12 and a longeron assembly 14 pivotably coupled to the base 12 toward a first end 13 of the longeron assembly 14. The longeron assembly 14 includes an elbow 16, which forms an apex 18 of the longeron assembly 14 and allows an upper portion of the longeron assembly 14 to pivot with respect to a lower portion of the longeron assembly 14. The longeron assembly 14, further includes a coupling member 20 configured to engage a portion 22 (FIG. 2A) of a vehicle 24 (FIG. 2A). The coupling member 20 can be positioned toward a second end 23 of the longeron assembly 14, opposed to the first end 13. The longeron assembly 14 is configured such that the coupling member 20 and the upper portion of the longeron assembly 14 can pivot about a first axis 26 positioned proximate the apex 18, and the apex 18 can pivot about a second axis 28 positioned proximate the base 12. In one embodiment, the first and second axes 26, 28 are parallel and extend in a substantially transverse direction with respect to an axis 29 along which the lifting apparatus 10 is elongated.

The lifting apparatus 10 further includes a bell crank 30 pivotably coupled to at least one lift member 32 toward a first portion 34 of the bell crank 30 and a first end 35 of the lift member 32. The bell crank 30 is further pivotably coupled to a biasing device 36 toward a second portion 38 of the bell crank 30. A third portion 40 of the bell crank 30 is pivotably coupled to the base 12. In turn, the coupling member 20, positioned toward the second end 23 of the longeron assembly 14, is also pivotably coupled to the lift member 32 toward a second end 41 of the lift member 32, opposed to the first end 35.

Figure 2B:
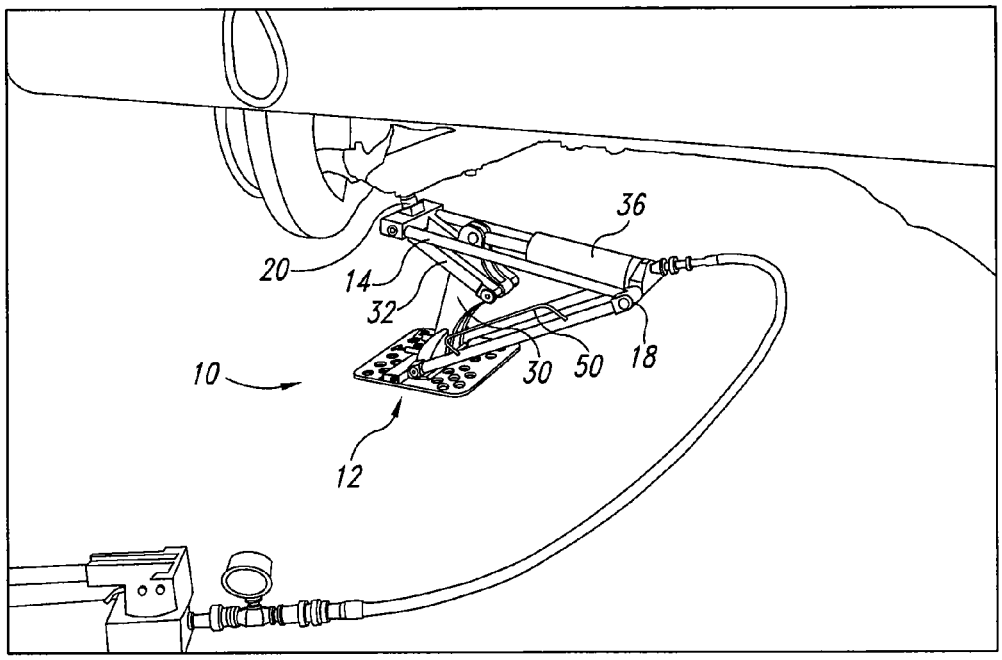
FIG. 2B illustrates an isometric view of the lifting apparatus of FIG. 1 in a second state.

In operation, the illustrated coupling member 20 is engaged with the portion 22 of the vehicle 24 as shown in FIGS. 2A and 2B. The biasing device 36 is activated to impart motion to the second portion 38 of the bell crank 30 and pivot the bell crank 30 about the base 12. The first portion 34 of the bell crank 30 is positioned such that pivoting of the bell crank 30 about the base 12 raises the first portion 34 away from a surface on which the lifting apparatus is supported. Since the lift member 32 is pivotably coupled at opposing ends to the first portion 34 of the bell crank 30 and to the coupling member 20, the lift member 32 is raised by the bell crank 30 and imparts a force to the vehicle 24 via the coupling member 20 to lift the vehicle 24. As the coupling member 20 travels away from the surface, the vehicle 24 is lifted proximate the portion 22 thereof. As the lift member 32 raises, it also can pivot in a first direction with respect to a third axis 44 (FIG. 1) positioned proximate the first portion 34 of the bell crank 30 and in a second direction, opposed to the first direction, with respect to a fourth axis 46 (FIG. 1) positioned proximate the coupling member 20 such that the coupling member 20 exerts a vertical force to the portion 22 of the vehicle 24 to which the coupling member 20 is engaged. In one embodiment, the third and fourth axes 44, 46 extend in a substantially transverse direction with respect to the axis 29 along which the lifting apparatus 10 is elongated.

Since the longeron assembly 14 is coupled to the coupling member 20, any transverse motion imparted by the vehicle 24 onto the coupling member 20, transversely shifts the first end 13 of the longeron assembly 14. Shifting the first end 13 of the longeron assembly 14 induces a pivoting of the longeron assembly 14 about the second axis 28 proximate the base 12. The second end 23 of the longeron assembly 14, toward which the coupling member 20 is positioned, can also pivot with respect to the first axis 26 proximate the apex 18 while the lift arm 32 pivots with respect to one or both of the third and fourth axes 44, 46. In this manner, the apex 18 of the longeron assembly 14 separates from the surface while the coupling member 20 shifts with the vehicle 24 as shown in FIG. 2B.

Accordingly, the longeron assembly 14 can pivot with respect to the base 12, and the lift arm 32, and the bell crank 30 can pivot with respect to the base 12 and the longeron assembly 14 to compensate for the transverse shift in a position of the vehicle 24. Although the coupling member 20 shifts with the vehicle 24, the lifting apparatus 10 maintains the vehicle 24, or the portion 22 thereof, in a lifted position at a substantially constant distance from the ground.

The biasing device 36 may include a coil spring, a pneumatic pump, a hydraulic pump, a cylinder and piston apparatus, a manually activated biasing device, any combination thereof, or any other suitable biasing device configured or operable to impart motion onto a portion of the bell crank 30.

In some embodiments, the lifting apparatus 10 may include at least one, or as shown two rotation limiting members 48 (FIG. 2A), which may also aid stabilizing the base 12. Additionally, or alternatively, the lifting apparatus 10 may include at least one handle 50 (FIG. 2B) attached to one of the components thereof, such as a portion of the longeron assembly 14, for aiding in lifting, moving, and transporting or storing the lifting apparatus 10.

One of ordinary skill in the art will appreciate that various embodiments may include more features or less features than that described above while exhibiting the relative motion of the longeron assembly, biasing device, and bell crank device with respect to the base and/or each other.

Figure 3:
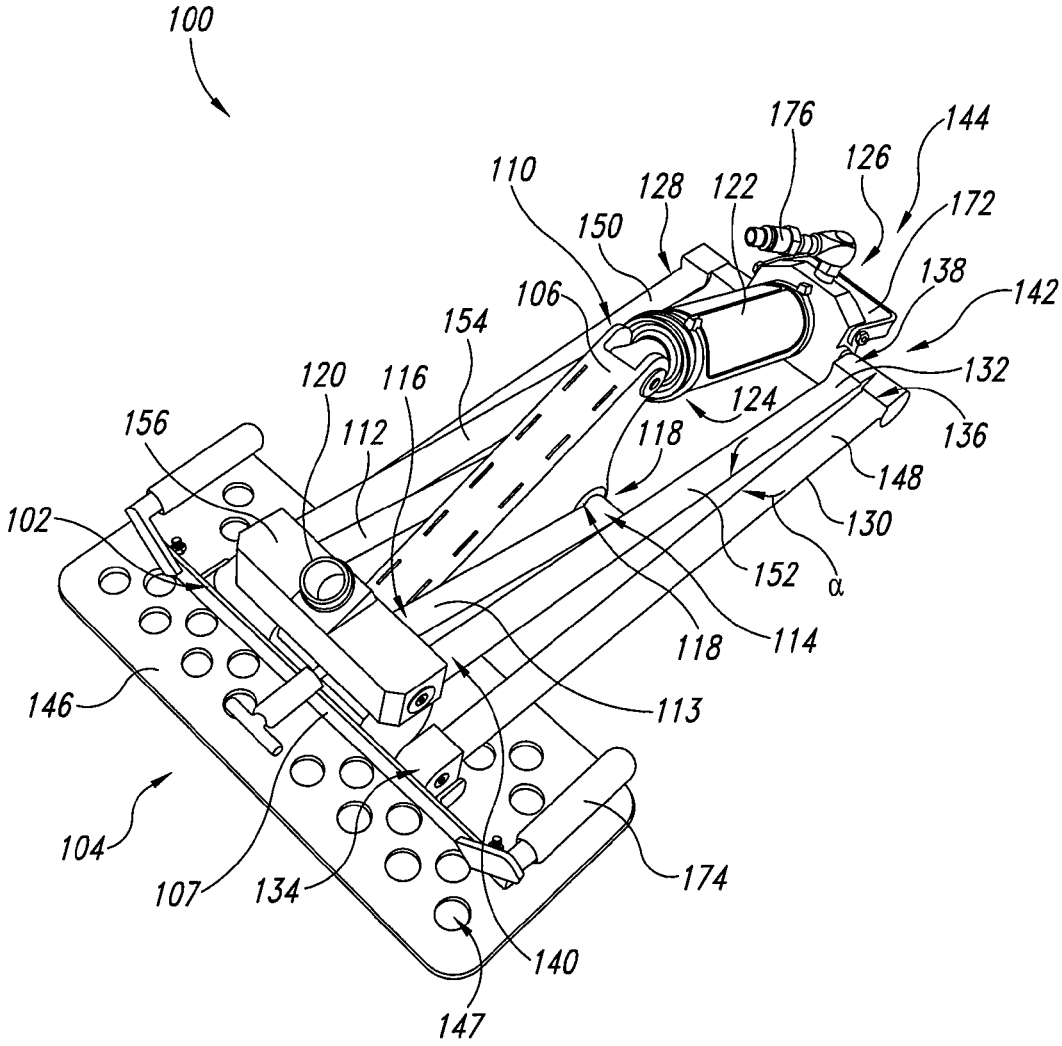
FIG. 3 illustrates an isometric view of a lifting apparatus according to another embodiment.
Figure 4A:
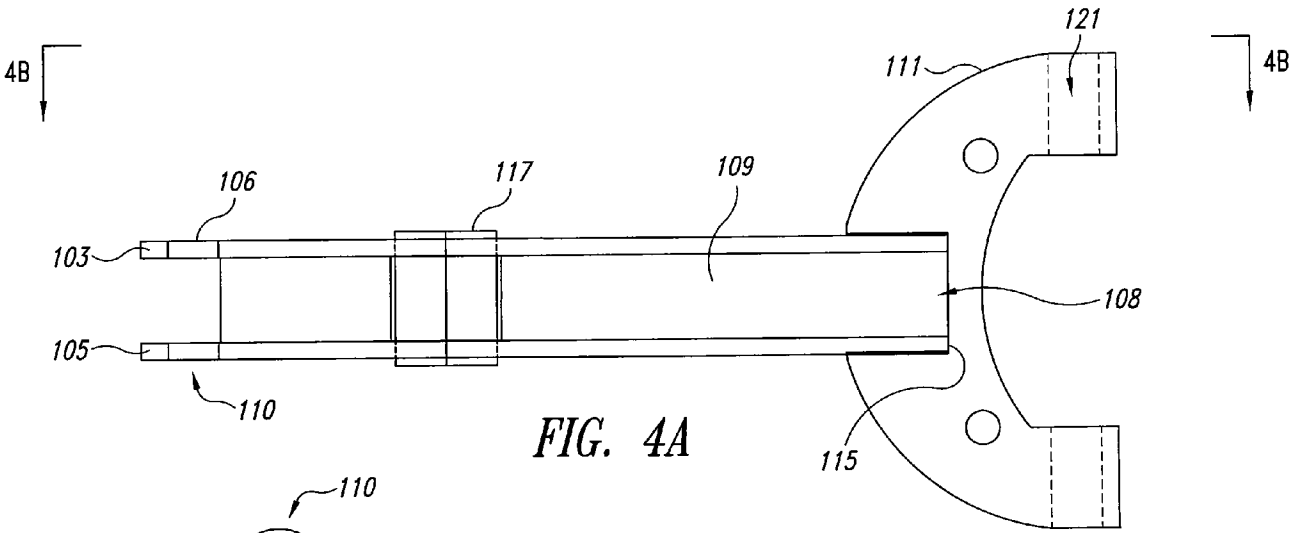
FIG. 4A illustrates a top view of a portion of the lifting apparatus of FIG. 3.
Figure 4B:
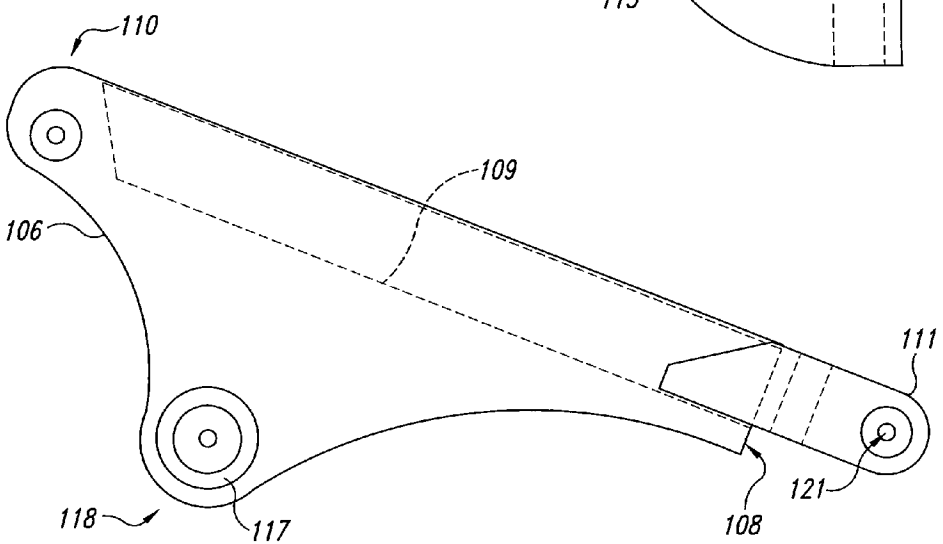
FIG. 4B illustrates a side view of the portion illustrated FIG. 4A.

FIG. 3 illustrates another embodiment, in which a portable lifting apparatus 100 for lifting at least a portion of a vehicle comprises a base 102 positioned toward a first lateral end 104 of the lifting apparatus 100. The base 102 is configured to support the apparatus 100 on an even or uneven surface. The base 102 can be fabricated from any material capable of supporting the lifting apparatus on a surface, such as metals, woods, and composites. The lifting apparatus 100 further comprises a bell crank 106 operable to convert a force received in a first direction to a force exerted in a second direction, different from the first direction. As illustrated in FIG. 4B, the bell crank 106 includes a first end 108 and a second end 110. As illustrated in FIG. 3, toward its first end 108 (FIG. 4B), the bell crank 106 is pivotably coupled to the base 102.

In some embodiments, the bell crank 106 can be fabricated from a unitary body of material. As illustrated in FIGS. 4A and 4B, in other embodiments, the bell crank 106 can include a sub assembly. For example, the bell crank 106 can include a first plate 103, a second plate 105, and a coupling spacer 109 fixedly coupling the first and second plates 103, 104, for example, by being welded therebetween, maintaining a substantially constant distance between the first and second plates 103, 105.

For example, the coupling spacer 109 can include a square tubular cross-section and extend from proximate the first end 108 to proximate the second end 110 of the bell crank 106. The bell crank 106 can either directly or indirectly couple to a portion of the base 102 in any suitable manner in which the bell crank 106 can pivot with respect to the base 102. Examples include, but are not limited to, a lug and pin mechanism, a hinge mechanism, via a flexible material, or any other suitable coupling method.

Figure 4C:
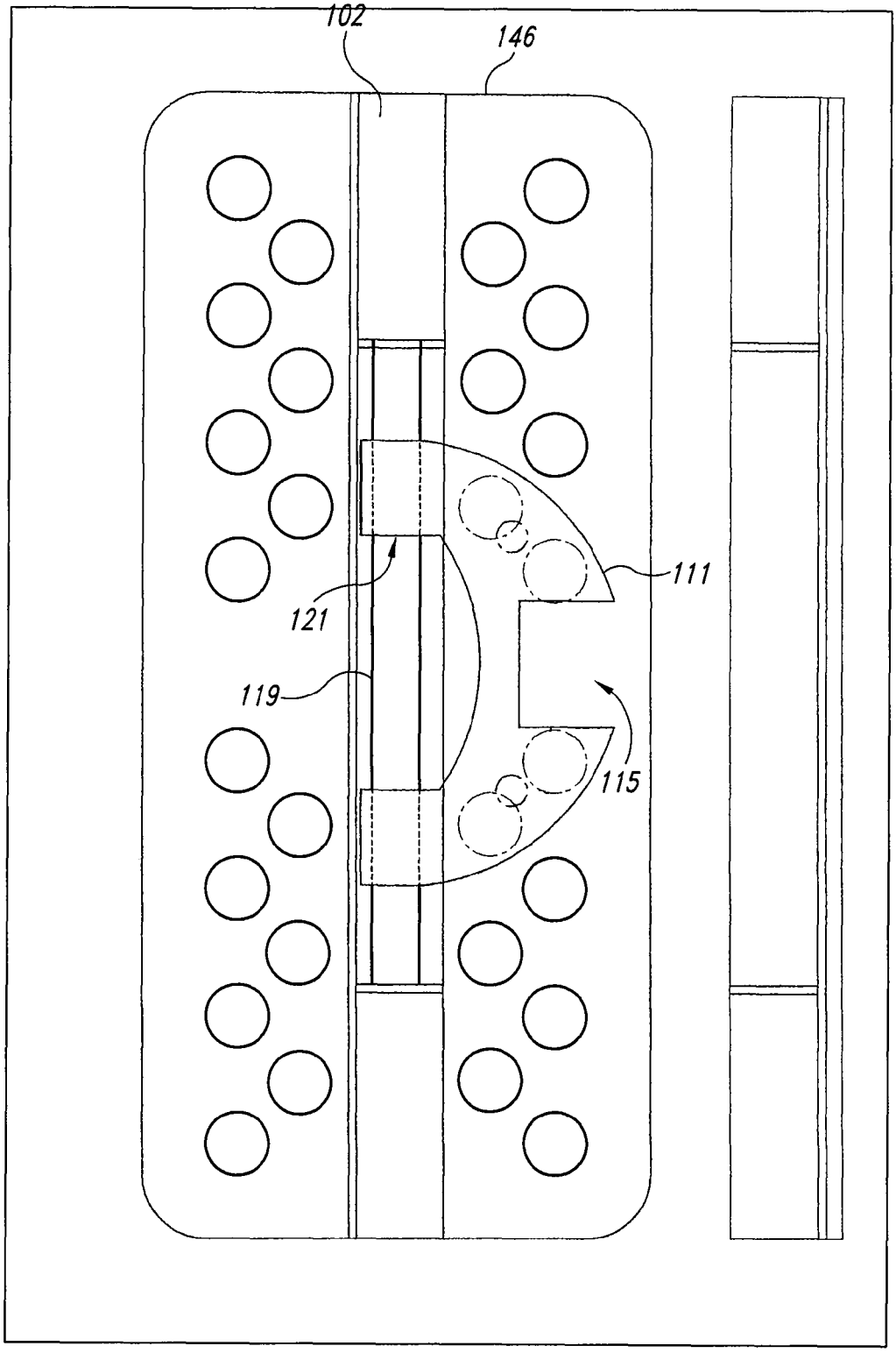
FIG. 4C illustrates a top view of another portion of the lifting apparatus of FIG. 3.

In one embodiment, as illustrated in FIGS. 4A and 4B, the lifting apparatus 100 may comprise a support member 111, such as a clevis-type member, configured to pivotably couple to the base 102 toward a first end thereof and rigidly attach to the bell crank 106 toward a second end, opposed to the first end. For example, the support member 111 can rigidly attach to the bell crank 106 at a recess 115 formed in the support member 111 by being welded or threadedly engaged thereto. The support member 111 can be pivotably coupled to the base 102 via a pin 119 (FIG. 4C) extending through bores or recesses 121 formed toward the first end of the support member 111. The pin 119 can be rotatably mounted to at least a portion of the base 102. The support member 111 is configured to pivot with the bell crank 106, providing additional support when the lifting apparatus 100 is loaded to distribute and transfer the load to the base 102, as illustrated in FIGS. 4A-4C.

As illustrated in FIG. 3, the lifting apparatus 100 further includes at least one lift member 112 having a first end 114 and a second end 116. Toward the first end 114, the lift member 112 is pivotably coupled to a coupling portion 118 of the bell crank 106 positioned between the first and second ends 108, 110 of the bell crank 106. The at least one lift member 112 may be coupled to the coupling portion 118 of the bell crank 106 using any suitable coupling device 117 (FIGS. 4A and 4B) such as a bushing and/or a bearing member. The coupling device 117 can also aid in providing additional support and maintaining a substantially constant distance between the first and second plates 103, 105 of the bell crank 106, as illustrated in FIGS. 4A and 4B.

The lifting apparatus 100 also includes a coupling member 120 pivotably coupled to the second end 116 of the lift member 112. The coupling member 120 is configured to securely engage a mating portion of the vehicle, transferring a load from the lifting apparatus 100 to a mating portion of the vehicle for lifting at least a portion of the vehicle for changing tires, other maintenance, or any other suitable purpose. The portion of the coupling member 120 engaging the mating portion of the vehicle can be any suitable shape, such as a spherical shape, a receptacle shape, a cup, a vice shape, or any other shape configured to securely engage the mating portion of the vehicle.

The lifting apparatus 100 further comprises a biasing device 122 having a first end 124 and a second end 126. The first end 124 of the biasing device 122 is pivotably coupled to the second end 110 of the bell crank 106. The biasing device 122 is operable to exert a first force on the second end 110 of the bell crank 106 for pivoting the bell crank 106 about the base 102 and shifting the lift member 112 from a first retracted position, illustrated in FIG. 3, to a second extended position, similar to the extended position of the above embodiment shown in FIG. 2A.

Figure 5:
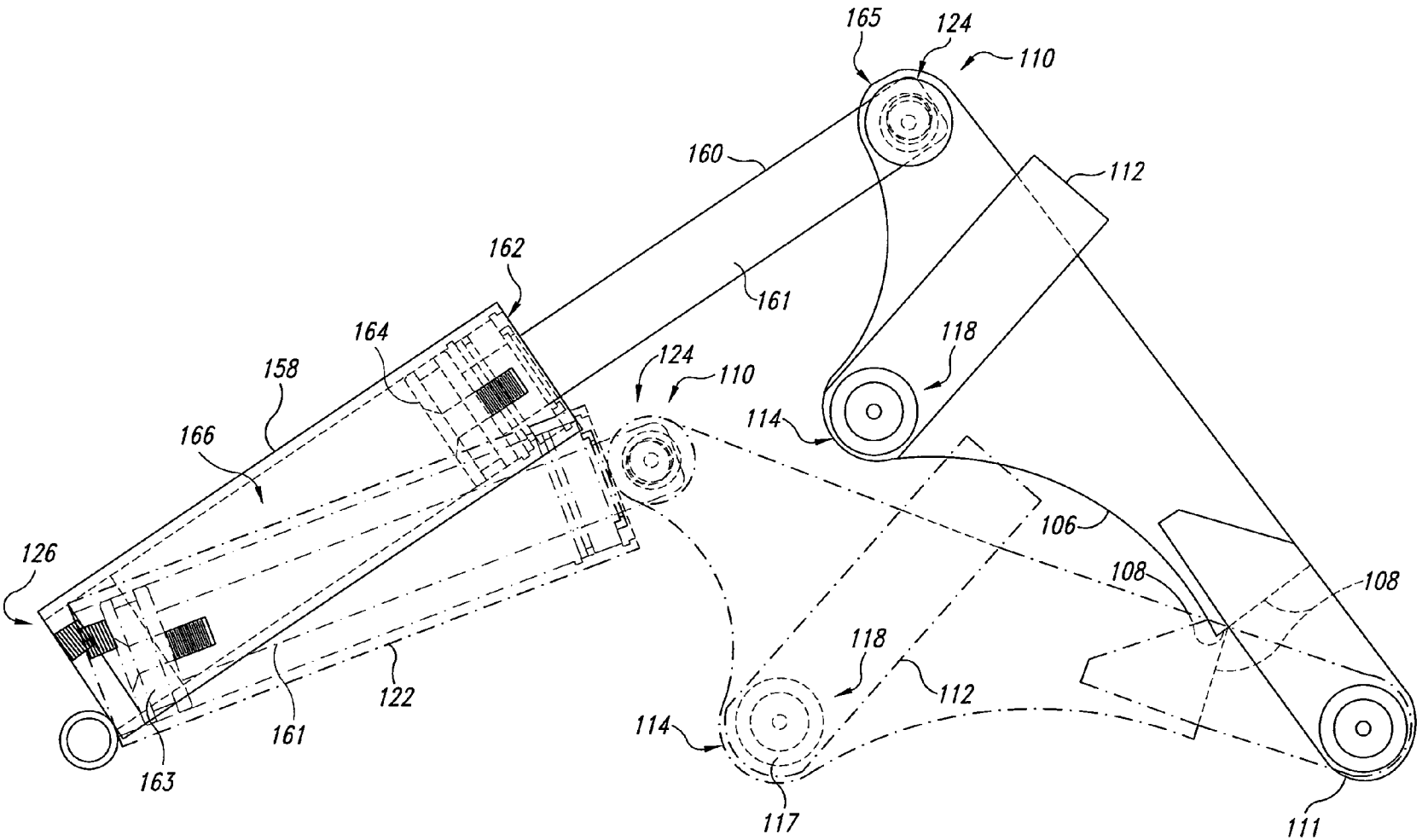
FIG. 5 illustrates a side view of a portion of the lifting apparatus of FIG. 3 shown in a first state and in a second state.

FIG. 5 is a schematic illustrating a movement of the first end 124 of the biasing device 122 from a first retracted state to a second extended state, to apply the force to the second end 110 of the bell crank 106 and lift the at least one lift member 112. FIG. 5 superimposes the positions of the biasing device 122, bell crank 106, and lift member 112 before and after the biasing device 122 exerts the first force on the bell crank 106. Pivoting of the bell crank 106 raises the second end 110 and coupling portion 118 of the bell crank 106. Since the first end 114 of the lift member 112 is coupled to the coupling portion 118 of the bell crank 106, the lift member 112 raises in response to a second force exerted by the bell crank 106 on the lift member 112 at the coupling portion 118. As the lift member 112 is raised, the second end 116 of the lift member 112 exerts a third force on the coupling member 120, the third force transferring through the coupling member 120 to the mating portion of the vehicle to lift a portion of the vehicle.

Accordingly, the bell crank 106 converts the first force having the first direction from the biasing device 122, to the second force exerted in the second direction, different from the first direction, applied to the lift member 112. The term bell crank is used herein and in the claims that follow for clarity of description; however, those of ordinary skill in the art will appreciate that the bell crank 106 can be any device, mechanism, structure, assembly, apparatus, or system, or any combination thereof suited to receive a force applied in a first direction and convert it to a force applied in a second direction, different from the first direction.

The lifting apparatus 100 further comprises a longeron assembly 128, illustrated in FIG. 3. In one embodiment, the longeron assembly 128 includes a first elongated portion 130 and a second elongated portion 132. The first elongated portion 130 comprises first and second ends 134, 136 and the second elongated portion 132 comprises first and second ends 138, 140. The first end 134 of the first elongated portion 130 is pivotably coupled to the base 102 and the second end 136 of the first elongated portion 130 is pivotably coupled to the first end 138 of the second elongated portion 132, forming an apex 142 of the longeron assembly 128 toward a second lateral end 144 of the lifting apparatus 100, substantially opposite the first lateral end 104.

The first and second elongated portions 130, 132 form an adjustable acute angle $\alpha$ therebetween. Furthermore, the second end 140 of the second elongated portion 132 can be rigidly attached to the coupling member 120, such that a lateral shift of the coupling member 120, for example induced by the vehicle when the lifting apparatus is in use, causes a lateral shift of the second end 140 of the second elongated portion 132.

In addition, the second end 126 of the biasing device 122 is pivotably attached to the longeron assembly 128 proximate the apex 142. The longeron assembly 128 is configured to pivot about the base 102 in response to a substantially lateral shift of the vehicles position, repositioning the biasing device 122, the bell crank 106, and the lift member 112. This compensates for the lateral shift of the vehicle when the coupling member 120 is engaged with the mating portion of the vehicle and the lift member 112 is in the second extended position. Since the second elongated portion 132 is rigidly coupled to the coupling member 120, the lateral shift of the vehicle's position, which shifts the coupling member 120, also shifts the second elongated portion 132. Due to the shifting of the second elongated portion 132, the longeron assembly 128 pivots at the first end 134 of the first elongated portion 130 about the base 102. As the longeron assembly 128 pivots, the apex 142 thereof shifts laterally, similar to the position of the lifting apparatus 10 discussed above in conjunction with FIG. 2B.

Movement of the apex 142 induces a shift in the biasing device 122 and the second end 110 of the bell crank 106. Additionally, since the second end 116 of the lift member 112 is pivotably coupled to the coupling member 120, the second end 116 of the lift member 112 is also laterally shifted with the vehicle, also shifting the coupling portion 118 of the bell crank 106. Since the biasing device 122 is pivotably coupled to the second end 110 of the bell crank 106 and the lift member 112 is pivotably coupled to the coupling portion 118 of the bell crank 106, the bell crank 106 rotates when the vehicle shifts laterally, to reposition the lift member 112 and adjust the angle $\alpha$ between the first and second elongated portions 130, 132 of the longeron assembly 128, to maintain the vehicle lifted at a substantially constant distance from the surface.

Typically, conventional vehicle jacks collapse when the vehicle shifts laterally, especially in case of heavy vehicles, such as trucks and military vehicle, for example, a Humvee vehicle. In contrast, to prevent collapsing, the longeron assembly 128 of the present invention interacts with the vehicle and portions of the lifting apparatus 100 that participate in lifting the vehicle, such as the bell crank 106, the lift member 112 and the biasing device 122 to reposition these components as described above.

As illustrated in FIG. 3, in one embodiment, the lifting apparatus 100 may comprise a base plate 146 configured to be removably coupled to the base 102 and to support the lifting apparatus 100 against an even or uneven surface. The base plate 146 can be configured to support the lifting apparatus 100 and/or the vehicle on a soft surface such as on dirt or sand. For example, the base plate 146 may comprise a surface area sized to prevent excess concentration of a load on the base plate 146 exerted thereon by the lifting apparatus 100 and/or the vehicle when supported by the lifting apparatus 100.

Accordingly, the lifting apparatus 100 is configured to lift the vehicle in stringent conditions, for example in a desert or other terrain having an uneven or soft surface. Furthermore, the base plate 146 may comprise a plurality of openings 147 configured to reduce a weight of the base plate 146. On certain surfaces, such as soft surfaces, the openings 147 also provide stability of the base plate 146 and thus of the lifting apparatus 100 by gripping portions of the surface.

The base 102 may comprise a stiffening member 107 configured to stiffen the base plate 146 and couple the base 102 to the base plate 146.

Additionally, or alternatively, as shown in the illustrated embodiment, the first and second ends 108, 110 of the bell crank 106 and the coupling portion 118 can be positioned at apices of a substantially triangular shape, more efficiently inducing a rotation of the bell crank 106 in response to the lateral shift of the vehicle.

In one embodiment, such as the embodiment illustrated in FIG. 3, the first elongated portion 130 of the longeron assembly 128 includes first and second elongated members 148, 150 and the second elongated portion 132 includes first and second elongated members 152, 154. Furthermore, the lifting apparatus 100 includes first and second lift members 112, 113. In this embodiment, the bell crank 106 is laterally positioned between the first and second lift members 112, 113. Furthermore, the first and second lift members 112, 113 can be laterally positioned between the first and second elongated members 152, 154 of the second elongated portion 132 of the longeron assembly 128. The first and second elongated members 152, 154 of the second elongated portion 132 can be positioned laterally between the first and second elongated members 148, 150 of the first elongated portion 130.

Furthermore, the longeron assembly 128 may further comprise a first transverse member 156, coupling the first and second elongated members 152, 154 of the second elongated portion 132 toward the second end 140 thereof, the transverse member 156 being rigidly attached to the coupling member 120. In this embodiment, the transverse member 156 is pivotably coupled to the first and second lift members 112, 113.

Figure 6A:
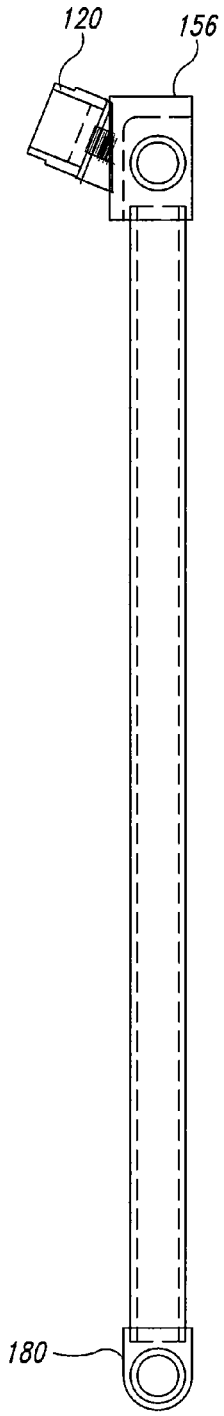
FIGS. 6A and 6B illustrate top and side views of a portion of the lifting apparatus of FIG. 3.
Figure 6B:
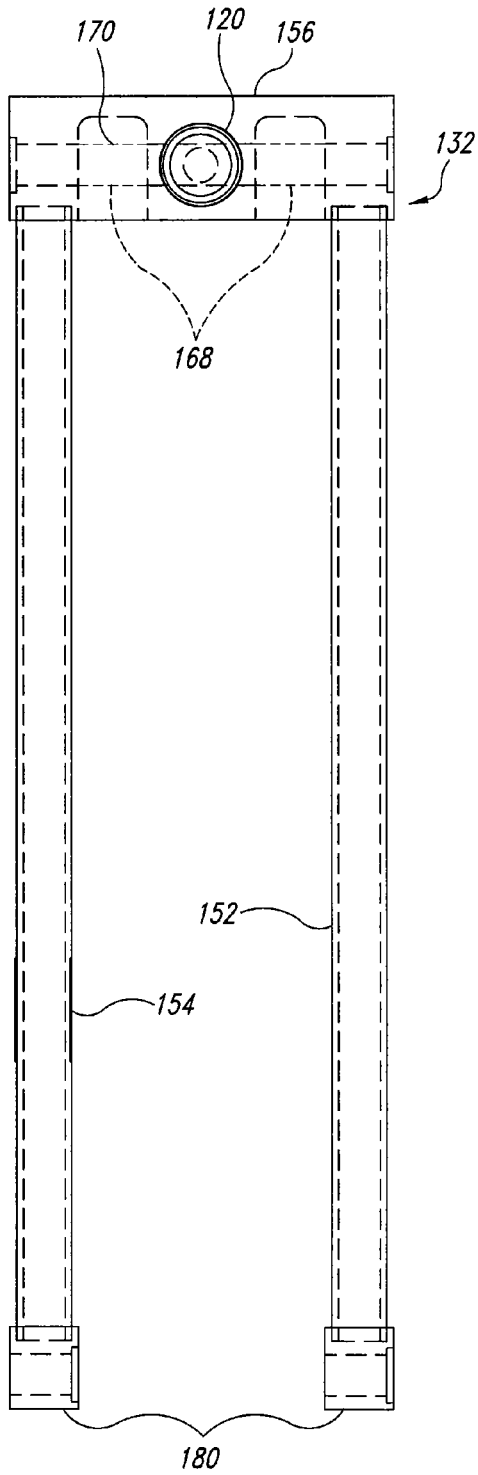

For example, FIGS. 6A and 6B illustrate one embodiment, in which the second elongated portion 132 includes the first and second elongated members 152, 154, and the transverse member 156. In this embodiment, the transverse member 156 may comprise at least one structural feature 168, such as a receptacle, bore, or a recess, configured to receive and pivotably couple to the first and second lift members 112, 113. For example, the transverse member 156 can be pivotably coupled to the second ends of the first and second lift members 112, 113 using a pin 170 extending through the structural feature 168 of the transverse member 156 and bores of the first and second lift members 112, 113, the bores extending in a substantially transverse or lateral direction. As illustrated in the side view of the second elongated portion 132, the coupling member 120 may threadedly attach to the transverse member 156.

Furthermore, the biasing device 122 can comprise a cylinder 158 and a piston 160 as illustrated in FIG. 5. In one embodiment, the cylinder 158 can include a hydraulic cylinder having a first end 162 toward the first end 124 of the biasing device 122 and a second end forming the second end 126 of the biasing device 122. Furthermore, the piston 160 includes a first end 164 positioned inside the cylinder 158 proximate the first end of the cylinder 158, when the lift members 112, 113 are in the first retracted position, and proximate the second end 162 of the cylinder 158, when the lift members 112, 113 are in the second extended position. The piston 160 further includes a second end 165 positioned outside the cylinder, forming the first end 124 of the biasing device 122 and coupled to the second end 110 of the bell crank 106. The piston 160 further comprises a piston rod 161 coupled to a piston base 163 sealably positioned within the cylinder 158 toward a first end 164 of the piston 160. The piston base 163 may couple to the piston rod 161 by any suitable means, such as being welded or threadedly coupled.

In this embodiment, the cylinder 158 comprises a volume 166 configured to receive a fluid, such as a hydraulic fluid, forcing the first end 164 of the piston 160 away from the second end 126 of the biasing device 122. In this manner, the second end 165 of the piston 160 extracts out of the cylinder 158, exerting the first force on the bell crank 106 at the second end 110 thereof. This causes the bell crank 106 to pivot about the base 102 and lift the lift members 112, 113 to raise the portion of the vehicle.

Furthermore, in one embodiment and as illustrated in FIG. 3, the lifting apparatus 100 may include a first handle member 172 pivotably coupled to a portion of the lifting apparatus 100, for example proximate the apex 144 of the longeron assembly 128 and/or proximate the second end 126 of the biasing member 122. The first handle member 172 is configured to allow a user carry the lifting apparatus 100. Furthermore, the lifting apparatus 100 may comprise at least a second handle member 174 rigidly coupled to a portion of the base 102 and/or the base plate 146, configured to allow the user to position the base 102 and/or the base plate 146 on the surface.

The lifting apparatus includes a biasing device coupling member 176, such as a threaded valve member, configured to couple the cylinder 158 to an external pressure source, such as a source of hydraulic fluid or air.

The components of the longeron assembly 128, the lifting members 112, 113, and the bell crank 106 can be fabricated from any material capable of supporting loads induced by a vehicle having a gross weight up to and beyond 15,000 pounds. Examples include metals such as steel and titanium, composites, a combination thereof, or any other material having high strength for bearing loads associated with lifting the vehicle. Furthermore, pivotable coupling of the components described herein can be via any suitable coupling means such as bushings and bearings. Additionally, rigid attachments described herein can be via any suitable rigid attaching means such as threaded fastening and welding. Furthermore, ends of at least some components, such as the elongated members of the longeron assembly 128 may comprise various types of end adaptors 180 (FIGS. 6A and 6B), such as a block adapter having a blind bore or recess, to assist coupling the components.

Furthermore, the elongated members of the longeron assembly 128, the lift members 112, 113, and/or the transverse member 156 may comprise any cross-sectional shape, such as tubular, solid, circular, elliptical, rectangular, any combination thereof, and/or any other cross-sectional shape.

Figure 7A:
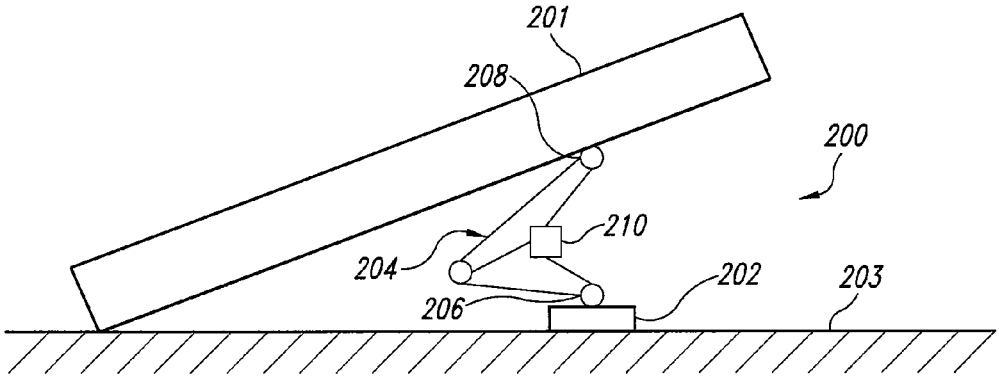
FIGS. 7A and 7B schematically illustrate a side view of a lifting apparatus according to yet another embodiment.

Furthermore, although example structures are discussed herein to facilitate lifting a structure and compensate for movement of the structure, the scope of present disclosure and the claims that follow is not limited to such structure. For example, as illustrated in a schematic in FIG. 7A, in its simple embodiment, a lifting apparatus 200 for a structure 201 above a surface 203 includes a base 202 configured to rest on the surface 203 to facilitate lifting the structure 201. The lifting apparatus 200 further includes a spacing assembly 204 having a first end 206 pivotably coupled to the base 202 and a second end 208 configured to engage a portion of the structure 201 and to move away from the base 202 to cause the lifting apparatus 200 to lift the structure 201 during operation.

Furthermore, the lifting apparatus 200 includes an actuating mechanism 210 coupled to the spacing assembly 204. The actuating mechanism 210 is configured to separate the second end 208 of the spacing assembly 204 from the base 202 to lift the structure 201. For example, the actuating mechanism 210 can include the bell crank and biasing devices discussed herein, a scissor jack, a manually operated jack, or any other suitable actuating mechanism that can bias the second end 208 away from the base 202. Accordingly, a movement of the structure 201 while the structure 201 is being lifted, or when the structure 201 is in a lifted state, is compensated by the spacing assembly 204 pivoting about the base 202 as shown in FIG. 7B where a portion 212 of the spacing assembly 204 is lifted away from the surface 203.

Figure 7B:
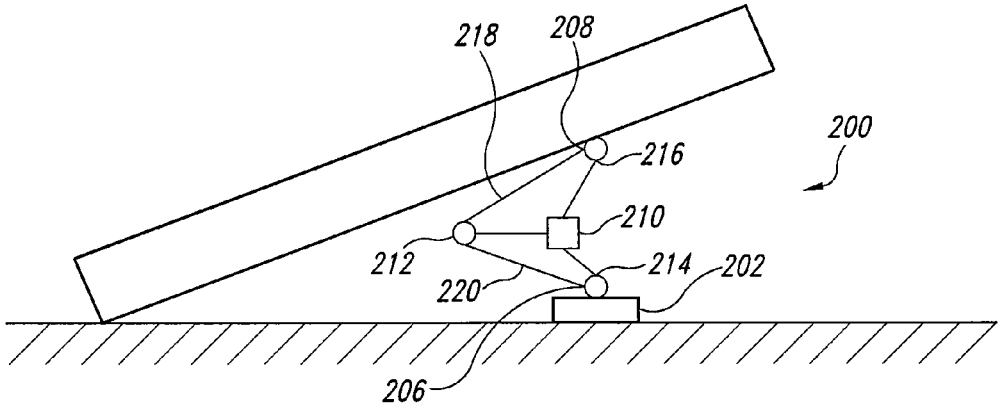

As illustrated in FIG. 7B, the actuating system 210 can include a first end 214 pivotably coupled to the base 202 and a second end 216 pivotably coupled to the spacing assembly 204, for example toward the first end 208 of the spacing assembly 210. Furthermore, in one embodiment, the spacing assembly 204 can include an upper portion 218 terminating at the first end 208 of the spacing assembly 204 and a lower portion 220 terminating at the second end 206 of the spacing assembly, the upper portion 218 being pivotably coupled to the lower portion 220, allowing separation of the first end 208 from the second end 206. For example, the upper and lower portions 218, 220 can be pivotably coupled at the portion 212 of the spacing assembly 204 that shifts with respect to the surface 203 when the spacing assembly 204 pivots with respect to the base 202.

Figure 7C:
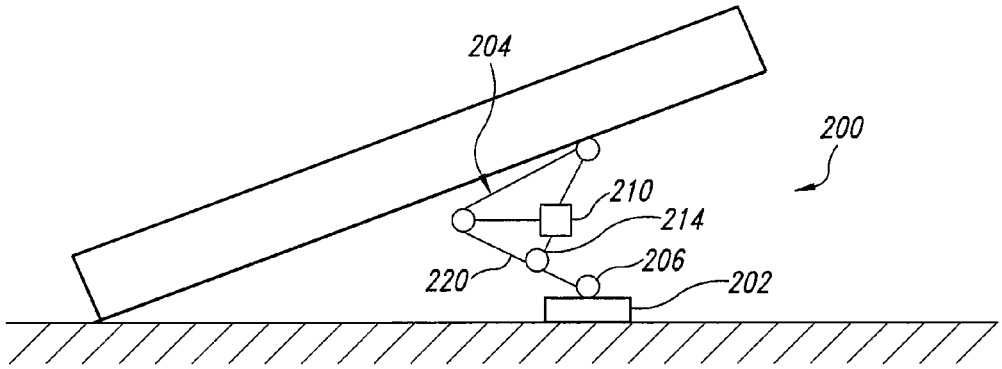
FIG. 7C schematically illustrates a side view of the lifting apparatus of FIGS. 7A and 7B according to another aspect.

Furthermore, in other embodiments, the actuating mechanism 210 need not necessarily be coupled to the base 202. For example, as shown in FIG. 7C, the actuating mechanism 210 can be coupled, for example pivotably coupled, to a portion of the spacing assembly 204, such as the lower portion 220 of the spacing assembly 204.

One of ordinary in the art will appreciate that a lifting apparatus or device according to other embodiments can be scaled to suit specific applications. For example, the lifting apparatus can be smaller for lifting smaller or lighter weight structures and larger for lifting larger or heavier structures.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A lifting apparatus for lifting a portion of a vehicle comprising:

a base positioned toward a first end of the lifting apparatus;

a bell crank having a first end and a second end, the first end of the bell crank pivotably coupled to the base;

at least a first lift member having a first end and a second end, the first end of the at least first lift member pivotably coupled to a coupling portion of the bell crank positioned between the first and second ends of the bell crank;

a coupling member pivotably coupled to the second end of the at least first lift member and configured to engage a portion of the vehicle;

a biasing device having a first end and a second end, the first end of the biasing device pivotably coupled to the second end of the bell crank, the biasing device being configured to exert a force on the second end of the bell crank, pivoting the bell crank about the base and shifting the at least first lift member from a first retracted position to a second extended position; and a longeron assembly having a first end and a second end, the longeron assembly being pivotably coupled to the base toward the first end and rigidly coupled to the coupling member toward the second end, the second end of the longeron assembly pivoting about at least one of a first axis and a second axis, with respect to the base, in response to a movement of the vehicle, the first end shifting with the vehicle and repositioning the biasing device, the bell crank, and the at least first lift member to compensate for the lateral shift of the vehicle, when the coupling member is engaged to the portion of the vehicle and the at least first lift member is in the second extended position.

2. The lifting apparatus of claim 1 wherein the longeron assembly further includes a first elongated portion and a second elongated portion, each of the first and second elongated portions having a first end and a second end, the first end of the first elongated portion being pivotably coupled to the base, and the second end of the first elongated portion being pivotably coupled to the first end of the second elongated portion forming an apex of the longeron assembly toward a second lateral end of the lifting apparatus, substantially opposite the first lateral end, the second end of the second elongated portion being rigidly attached to the coupling member.

3. The lifting apparatus of claim 2 wherein the first and second elongated portions each comprise first and second elongated members, and the bell crank, biasing device, and the at least first lift member are linked between the first and second elongated members of the first and second elongated portions.

4. The lifting apparatus of claim 3 wherein the longeron assembly further comprises a transverse member coupling the first and second elongated members of the second elongated portion toward the second end thereof, the transverse member being rigidly attached to the coupling member.

5. The lifting apparatus of claim 4, further comprising:

a second lift member extending substantially parallel to the first lift member and having a first end and a second end, the first end of the second lift member being pivotably coupled to the coupling portion of the bell crank, wherein the transverse member is pivotably coupled to the first and second lift members toward the second ends thereof.

6. The lifting apparatus of claim 5 wherein the transverse member and the second ends of the first and second lift members respectively include at least one bore extending laterally therethrough, and a pin extending through the bores of the transverse member and the second ends of the first and second lift members for pivotably coupling the first and second lift members to the coupling member.

7. The lifting apparatus of claim 2 wherein the first elongated portion forms an adjustable acute angle with the second elongated portion.

8. The lifting apparatus of claim 7 wherein the biasing device is pivotably coupled to the longeron assembly toward the second end of the biasing device and proximate the apex.

9. The lifting apparatus of claim 1, further comprising:

a base plate removably coupled to the base and configured to support the lifting apparatus against an even or uneven surface, the base plate having a plurality of openings reducing a weight thereof and further stabilizing the base plate and the lifting apparatus.

10. The lifting apparatus of claim 9 wherein the base plate comprises a surface area sized to resist sinking in the soft surface and the plurality of openings are configured to receive therethrough a portion of the soft surface for further stabilizing the base plate and the lifting apparatus.

11. The lifting apparatus of claim 9, further comprising:

a stiffening member coupling the base to the base plate and stiffening at least a portion of the base plate.

12. The lifting apparatus of claim 9, further comprising:

at least a first handle rigidly attached to at least one of the base and the base plate, and configured to allow a user to manually manipulate and position the at least one of the base and the base plate.

13. The lifting apparatus of claim 1 wherein the first end, the second end, and coupling portion of the bell crank are positioned toward apices of a substantially triangular shape.

14. The lifting apparatus of claim 1, further comprising:

a second lift member wherein the bell crank is interposed between the first and second lift members.

15. The lifting apparatus of claim 1 wherein the biasing device comprises a cylinder and a piston, the piston having a piston base and a piston rod threadedly coupled to the piston base.

16. The lifting apparatus of claim 15 wherein the cylinder is a hydraulic or pneumatic cylinder having a first end forming the first end of the biasing device and a second end, and the piston includes a first end and a second end, the first end of the piston being positioned in an interior volume of the cylinder, proximate the first end of the cylinder when the at least first lift member is in the first retracted position, and proximate the second end of the cylinder when the at least first lift member is in the second extended position, and the second end of the piston being positioned outside the cylinder and forming the second end of the biasing device, the second end of the piston being configured to extend away from the cylinder in response to hydraulic or pneumatic pressure.

17. The lifting apparatus of claim 15, further comprising:

a regulating valve for coupling the cylinder to an external pressure source.

18. The lifting apparatus of claim 1, further comprising:

at least a second handle pivotably coupled to the lifting apparatus toward the second lateral end thereof, the second handle being configured to allow a user to manually manipulate or transport the lifting apparatus.

19. A lift apparatus for lifting a structure comprising:

a base;

a bell crank device pivotably coupled to the base and configured to receive a first force having a first direction and convert the first force to a second force having a second direction;

a coupling member configured to engage a portion of the structure, the coupling member being pivotably coupled to the bell crank device;

a longeron assembly having a first end, a second end, and an apex positioned therebetween, the longeron assembly being pivotably coupled to the base toward the first end and rigidly attached to the coupling member toward the second end, the second end being configured to pivot with respect to another portion of the longeron assembly about a first axis proximate the apex and with respect to the base about a second axis proximate the base; and a biasing device having a first end and a second end, the first end being pivotably coupled to the bell crank device for applying the first force thereto, the bell crank device converting the first force to the second force and applying the second force to the coupling member for lifting the structure, a lateral shift in a position of the structure being compensated by a rotation in the second end of the longeron assembly repositioning the apex and the bell crank.

20. The lift apparatus of claim 19, further comprising:

a first lift arm; and a second lift arm, wherein the first lift arm extends parallel to the second lift arm;

the first and second lift arms are pivotably coupled to opposing lateral sides of the bell crank device toward a first end of the first and second lift arms;

the first and second lift arms are pivotably coupled on opposing lateral sides of the coupling member toward a second end of the first and second lift arms; and the biasing device is pivotably coupled to the longeron assembly toward the apex of the longeron assembly.

21. The apparatus of claim 19 wherein the bell crank device includes a first plate, a second plate, and a coupling spacer coupling the first and second plates and maintaining a substantially constant distance therebetween.

* * * * *